US007228942B2

(12) United States Patent
Takehara et al.

(10) Patent No.: US 7,228,942 B2
(45) Date of Patent: Jun. 12, 2007

(54) METHOD FOR ENERGY STORAGE FOR DC MOTOR POWERED LOAD HOISTING MACHINERY

(75) Inventors: Toru Takehara, San Mateo, CA (US); Kinya Ichimura, Foster City, CA (US)

(73) Assignee: Paceco Corp., Hayward, CA (US)

( * ) Notice: Subject to any disclaimer, the term of this patent is extended or adjusted under 35 U.S.C. 154(b) by 467 days.

(21) Appl. No.: 10/773,483

(22) Filed: Feb. 6, 2004

(65) Prior Publication Data

US 2005/0173197 A1 Aug. 11, 2005

(51) Int. Cl.
*B66B 1/06* (2006.01)

(52) U.S. Cl. ..... 187/290; 187/297

(58) Field of Classification Search ..... 187/277, 187/290, 293, 296, 297; 318/139, 375, 376
See application file for complete search history.

(56) References Cited

U.S. PATENT DOCUMENTS

| | | | | |
|---|---|---|---|---|
| 4,399,892 | A * | 8/1983 | Watanabe | 187/290 |
| 5,712,456 | A * | 1/1998 | McCarthy et al. | 187/290 |
| 5,900,597 | A * | 5/1999 | Fernkas | 187/297 |
| 5,909,017 | A * | 6/1999 | Born et al. | 187/297 |
| 5,936,375 | A * | 8/1999 | Enoki | 318/727 |

* cited by examiner

*Primary Examiner*—Jonathan Salata
(74) *Attorney, Agent, or Firm*—Bruce & McCoy; Ernest H. McCoy

(57) ABSTRACT

A method for energy storage and recovery for load hoisting equipment driven by a diode controlled DC motor and having an inverter controlling an induction motor which drives a flywheel whereby, utilizing rest power such as reverse power from the DC motor when lowering a load and unused power at small load or idle to accelerate rotation of a flywheel, whereby energy is stored, and the system is reversed when a load is lifted and power is consumed whereby the flywheel causes the induction motor to generate power and deliver it to the DC motor.

4 Claims, 4 Drawing Sheets

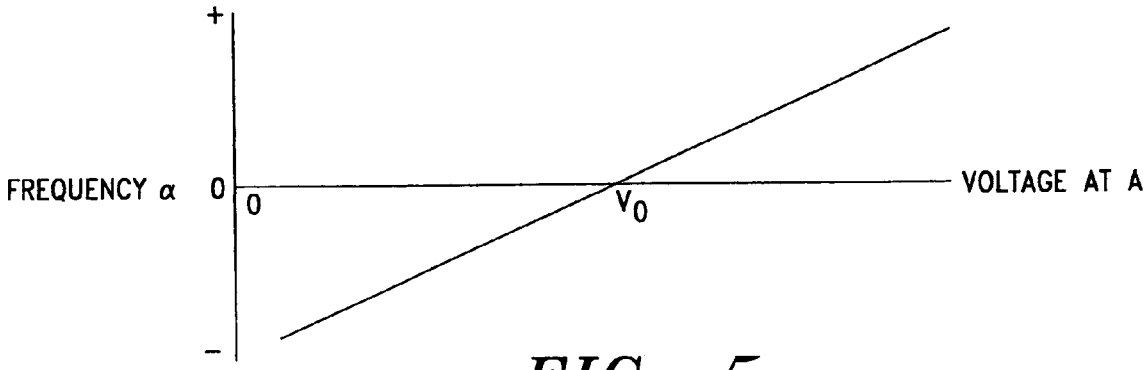
FIG.−5
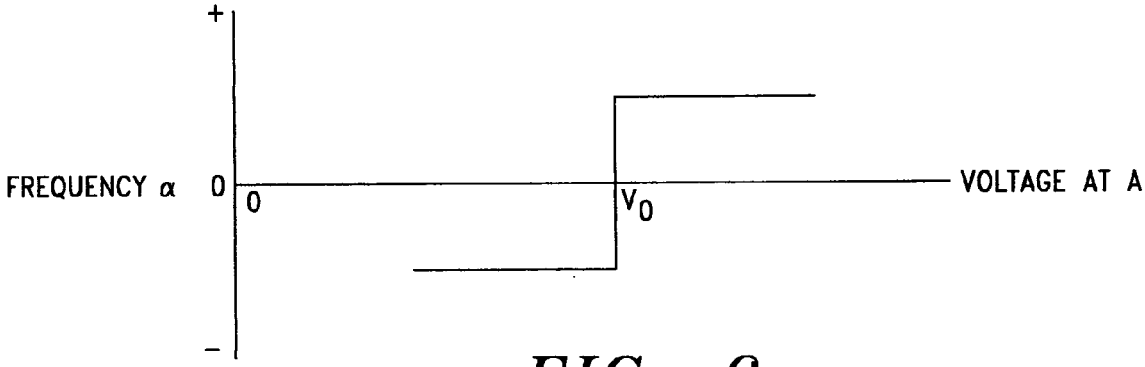
FIG.−6
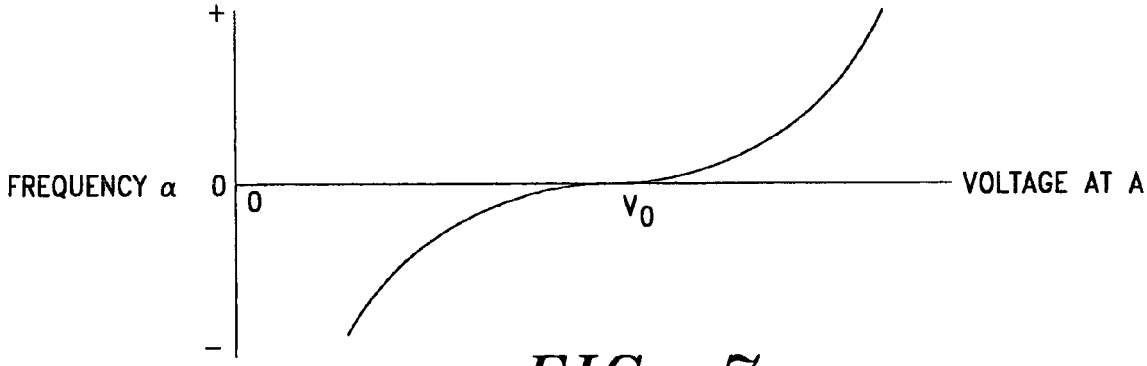
FIG.−7

METHOD FOR ENERGY STORAGE FOR DC MOTOR POWERED LOAD HOISTING MACHINERY

CROSS REFERENCES TO RELATED APPLICATIONS

The present invention is related to U.S. patent application Ser. No. 10/733454 filed Feb. 6, 2004.

BACKGROUND OF THE INVENTION

1. Field of the Invention

The present invention relates to improvements in a patented energy storage method for use with cranes and other load hoisting machinery. More particularly, it relates to improvements in a method for storing energy in a flywheel which is driven by the DC drive motor of the load hoisting machinery. The DC motor is powered during the load lowering process, and when the hoist machinery is not consuming power, to drive the flywheel. The energy is resupplied to the system when the load is being raised and needs more power.

2. Description of the Prior Art

The present invention relates to improvements in a system or method for energy storage in load hoisting cranes which are driven by electrical power. It is particularly useful for machinery which is driven by diesel-electric generators that experience a wide range of varying loads. The system stores energy at reverse or small load and supplies power at peak or large loads. Theoretically, this is a simple mechanical query, having as a result the benefit that the primary electrical source is only required to supply relatively constant average power and is not required to supply peak power. However, until now, the practical aspects of the query have prevented its use.

Combination battery and generator energy storage systems have been utilized to accomplish this result in the past, and theoretically they are very effective. However, in reality, the battery component imposes numerous problems such as: small electrical capacity, electrical inefficiency, large physical battery volume, heavy weight, and short battery life, whereby such a system is not currently a viable way to accomplish energy storage utilizing even state-of-the-art battery technology.

Flywheel type energy storage systems have also been utilized to accomplish the result. However, in order for the flywheel to store energy to create power, it must be capable of being driven over a wide range of speeds. In order to transmit the energy to the flywheel at the variable speeds, a DC motor has been utilized as most suitable, but the DC motor-driven flywheel has not been proven satisfactory for numerous reasons among which the following are most limiting:

1. In order for the flywheel to store energy, the energy is measured by $\frac{1}{2} \times I \times \omega^2$ where I=the moment of inertia, and $\omega$=the rotating angular speed. Therefore, high rotating speeds can store much more energy in the flywheel because the energy is measured by a square of the rotational speed. However, the DC motor which must be interconnected to the flywheel has severe rotational speed limitations due to the weak centrifugal strength of its rotor's coil component;

2. The DC motor requires continuous maintenance such as brush replacement, commutator repair, and maintaining insulation integrity;

3. A DC motor is comparatively large, heavy, and expensive.

For these reasons and others, the flywheel-driven energy storage type system utilizing a DC motor has likewise not been a viable way to accomplish the result.

Recent developments in inverter technology have progressed to the point where AC squirrel cage induction motors using inverters are replacing DC motors. The inverter converts DC to AC with arbitrary frequency and also converts AC to DC in reverse. By virtue of the AC arbitrary frequency, the AC squirrel cage induction motor can rotate with arbitrary rotational speed up to very high speeds solving some of the described problems associated with DC motors.

FIG. 1 of the drawings shows a typical example of currently utilized diesel-generator power sources and inverter controlled induction motor drive machinery for load hoisting machinery. The diesel engine 11 is mechanically interconnected to an AC generator 13. The alternating current output from the generator is converted to direct current by a diode 15. The DC, in turn, is converted to AC with an arbitrary frequency by the inverter 17. A squirrel cage induction motor 19 is driven by the AC and, in turn, drives a drum 21 which raises or lowers a load 23. The raising and lowering speeds are controlled as a result of the alternating current frequency generated and controlled by the inverter. When the load is lowered, reverse AC current is generated by the induction motor. The reverse current is consumed by a resistor 25 in order for the induction motor to operate effectively as degenerative braking.

FIG. 2 of the drawings discloses a typical example of current from a municipal utility power grid 27 being fed to the system by a cable reel power supply 29 instead of from the diesel engine/generator combination of FIG. 1. The incoming voltage is lowered by a transformer 31. The alternating current is then converted to DC by a DC converter 16 and, from that point on, the system is the same as disclosed in FIG. 1 of the drawings.

During lowering of the load 23, reverse current is sent back to the power grid 27 and, in this example, is used by other consumers. However, since the reverse power current includes surge and deviant frequencies, other consumers dislike receiving it. It is expected that in the future sending reverse power back to the power grid may be prohibited. In-that event, the reverse power will be consumed by a resistor, the same as disclosed in the system of FIG. 1.

FIG. 3 of the drawings discloses the improvement on the prior art which is inserted into the system in place of the resistor as utilized in FIG. 1 of the prior art systems. It is disclosed in U.S. Pat. No. 5,936,375, issued Aug. 10, 1999, for a Method for Energy Storage for Load Hoisting Machinery. The present invention includes further non-obvious improvements on that design.

SUMMARY OF THE INVENTION

The method of the present invention is provided for the desired purpose of energy storage and recovery for load-moving machinery systems powered by a DC motor which is controlled by an AC generator delivering power through a diode converter. The steps of the method of the invention comprise driving the DC motor of the load-moving machinery to act as a generator and create reverse power when the machinery is lowering or braking a load. The generated reverse power combined with unused power, which occurs when the machinery is at small load or idle, the combined powers being defined as rest power, drive an induction motor. A flywheel is rotated by the induction motor to store the rest power as energy. A rotational speed signal is generated proportional to the rotational speed of the flywheel. The voltage is measured at the power input side of the diode. The rotational speed signal and the measured voltage are transmitted to a programmable logic controller (PLC). The PLC controls the inverter so as to convert DC to AC with a controlled frequency. By controlling the electrical frequency, the rest power can be stored in the flywheel as rotational energy. Power can be retrieved from the flywheel to rotate the induction motor as a generator. The frequency is determined in the PLC by a programmed logic depending on the flywheel revolution speed. The induction motor is then rotated by the flywheel to produce power whereby power is returned through an inverter to the DC motor when it is consuming power in excess of average power consumption.

The present invention also includes new apparatus for performing the method thereof. The load moving machinery energy storage system is comprised of a direct current motor interconnected to a wire rope drum for raising and lowering a load. The motor is controlled by a diode and an energy storage system including a flywheel for storing and discharging energy. The flywheel is driven by an induction motor controlled by an inverter and driving a pulse generator. The storage system also includes a programmable logic controller (PLC) controlling the inverter, means for sensing voltage at the power input side of the diode, programmed logic for the programmable logic controller for comparing sensed voltage and the output of the pulse generator with a set voltage value, and an engine driven AC generator (ACG) producing power controlled by the diode for the load moving machinery.

OBJECTS OF THE INVENTION

It is therefore an important object of the present invention to provide an improved method for energy storage for the operation of DC motor-driven hoist machinery to reduce the overall power requirements for the operation of the machinery.

It is another object of the present invention to provide an improved method for energy storage for the operation of DC motor-driven hoist machinery to average out the power consumption requirements of the machinery.

It is a further object of the present invention to provide a method for the operation of DC motor-driven hoist machinery that eliminates the need to send power back to the source when the motor is driven by lowering the load or to absorb the power in a resistor or a brake.

It is still another object of the present invention to provide a method for energy storage for the operation of DC motor-driven hoist machinery that can utilize a flywheel for electrical energy storage.

And it is yet a further object of the present invention to provide a new apparatus for a DC motor-driven hoist machinery energy storage system that reduces the number of power inverters required to permit the system to function.

Other objects and advantages of the present invention will become apparent when the apparatus of the present invention is considered in conjunction with the accompanying drawings.

DESCRIPTION OF THE DRAWINGS

FIG. 5 is a graph showing the relationship of the frequency alpha and the voltage at point A in FIGS. 3–5 by which the inverter controls AC frequency;

FIG. 6 is the basic relationship for the operation of the graph of FIG. 6;

FIG. 7 is a more realistic relationship of the graph of FIG. 6 which is suitable for complex load variation in the operation of a crane;

DESCRIPTION OF THE PREFERRED EMBODIMENT

Reference is made to the drawings for a description of the preferred embodiment of the present invention wherein like reference numbers represent like elements on corresponding views.

Figure 1:
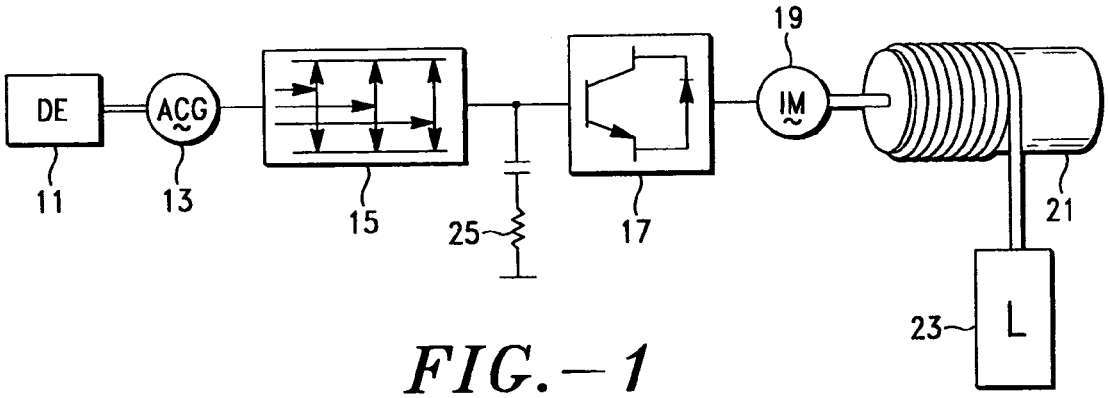
FIG.–1 (PRIOR ART)
FIG. 1 is a diagram of a standard prior art drive machinery arrangement for an autonomous load-hoisting crane.
Figure 2:
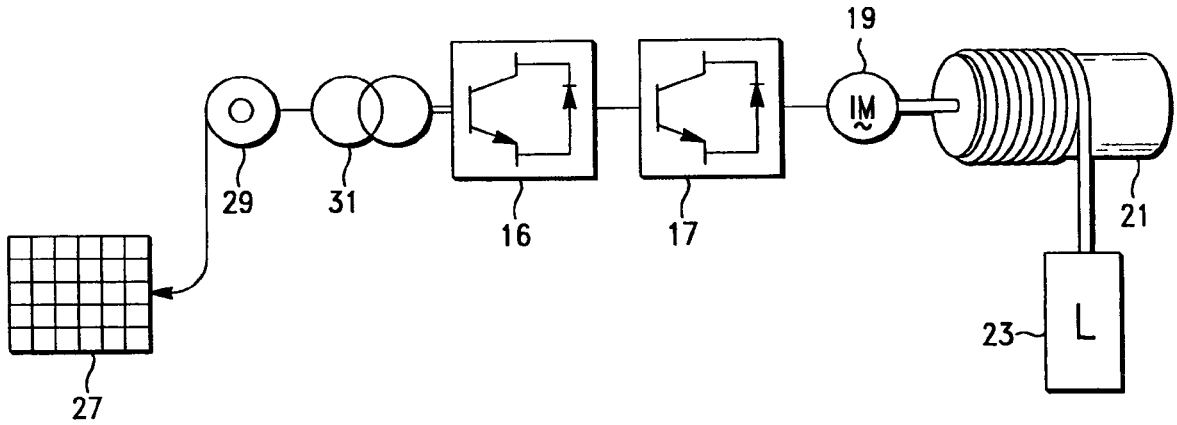
FIG.–2 (PRIOR ART)
FIG. 2 is a diagram of an alternative standard prior art drive machinery arrangement for an electrical power-driven crane.
Figure 3:
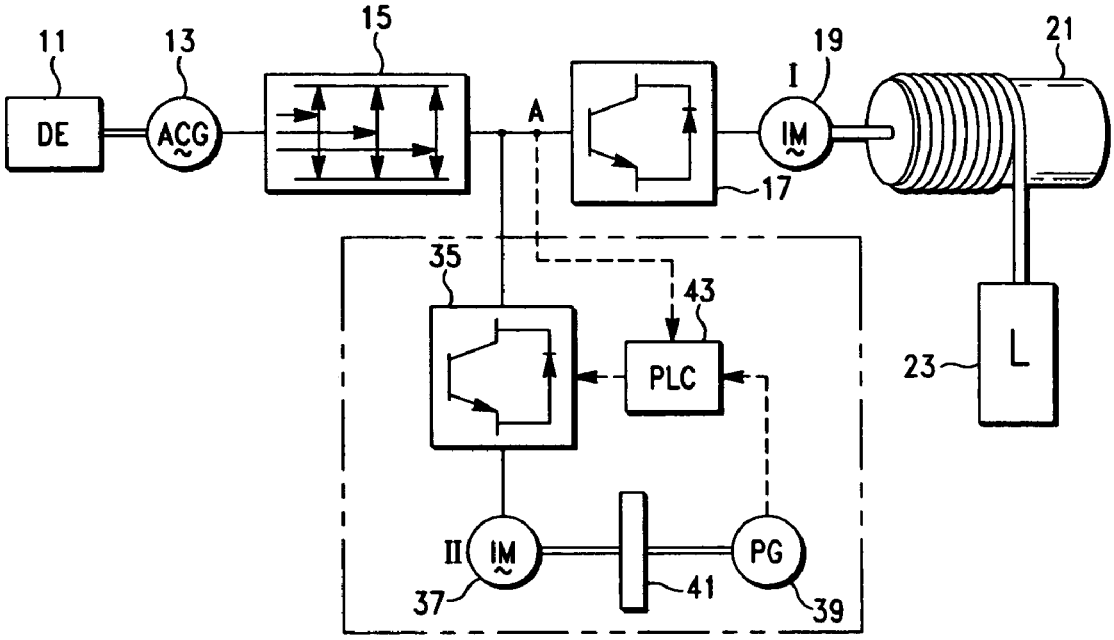
FIG. 3 is a diagram of a patented prior art method for energy storage for load hoisting machinery.

FIGS. 1–3 show the prior art of present practices as described above in the DESCRIPTION OF THE PRIOR ART portion of this specification. FIG. 3 shows the prior art patented apparatus which modifies the apparatus of FIG. 1 by the additions shown within the broken lines. The description of FIG. 1 in the DESCRIPTION OF THE PRIOR ART describes the operation of the primary apparatus items 11, 13, 15, 17, 19, 21 and 23.

Reference is made to FIG. 3 for a description of the environment of the present invention. When a load 23 is raised by the hoist machinery 21 of the system, in both the prior art and the present invention, electrical energy from either a municipal utility power grid or from an autonomous diesel engine powered generator 13 is utilized to operate a first induction motor 19 which is connected by a mechanical power transmission means to the load hoist wire rope drums 21. Power is consumed by the induction motor during hoisting the load and generated by it during lowering of the load.

The patented energy storage system is shown in FIG. 3 encircled by the broken line and is comprised of added machinery, which replaces the resistor 25 of FIG. 1, including: a second inverter 35, a second induction motor 37, a tachometer or pulse generator 39 which detects the rotational speed, a flywheel 4 1, and a programmable logic controller (PLC) 43.

When a load is being lowered by the hoist machinery 19 and 21, energy is stored in the rotation of the flywheel 41. This occurs from the following obvious relationships: the load hoist drum 21 reverse drives its hoist motor, the system's first induction motor 19, during lowering of the load 23. The first induction motor acts as a generator creating AC current or reverse power. The generated AC current is converted to DC by the first inverter 17 and the DC current flows between the diode 15 and the first inverter 17. As a result, the voltage at the point A becomes high.

The voltage at the point A also becomes high when the load hoist machinery is at idle, stopping, or hoisting a light load. Electricity supplied from the main power source, the AC generator or the municipal utility power grid, through the diode 15 elevates the voltage at the point A when the power consumption of the load hoist machinery is quite small or almost zero. This creates unused power. When the load hoist machinery hoists a heavy load, and its power consumption is large, the voltage at the point A becomes lower due to the lack of electricity.

The energy storage system works so as to store both the unused power and the generated reverse power produced by the first induction motor 19 when it is driven to act as a generator when lowering a load. The combined unused power and the reverse power are defined for purposes herein as rest power.

The rest power is controlled by a second inverter 35. A second induction motor 37 is driven by the rest power and is controlled by the second inverter to rotate the flywheel 41. The rest power is stored in the flywheel rotational energy when the voltage at point A is high. The system works so as to retrieve power from the flywheel rotational energy and supply the lack of electricity when the voltage at the point A is low.

The measured voltage at point A, and the rotational speed detected by a tachometer or pulse generator 39 which is connected to the flywheel 41, are transmitted or inputted to the programmable logic controller (PLC) 43. The PLC controls the second inverter 35 so as to convert DC to AC with a controlled frequency. The frequency is controlled by a programmed logic in the PLC depending on the voltage at point A and the rotational speed of the flywheel. The voltage at the point A is compared with a set voltage value $V_0$ which can be pre-set manually in the programmed logic.

If the voltage at point A is higher than the set or predetermined value $V_O$, the PLC 43 commands the second inverter 35 to convert DC to AC with the frequency corresponding to the rotational speed plus alpha whereby the flywheel 41 is accelerated by the second induction motor 37 and power is stored in the flywheel as rotational energy. If the voltage at the point A is lower than the set value $V_O$, the second inverter controls the AC with the frequency corresponding to the rotational speed minus alpha whereby the flywheel is decelerated by the second induction motor, thereby generating power which is supplied to the first induction motor whereby energy is recovered from the flywheel. By controlling the frequency, the second induction motor can be controlled to act as either a motor or generator to accelerate the flywheel or retrieve energy from it.

Figure 4:
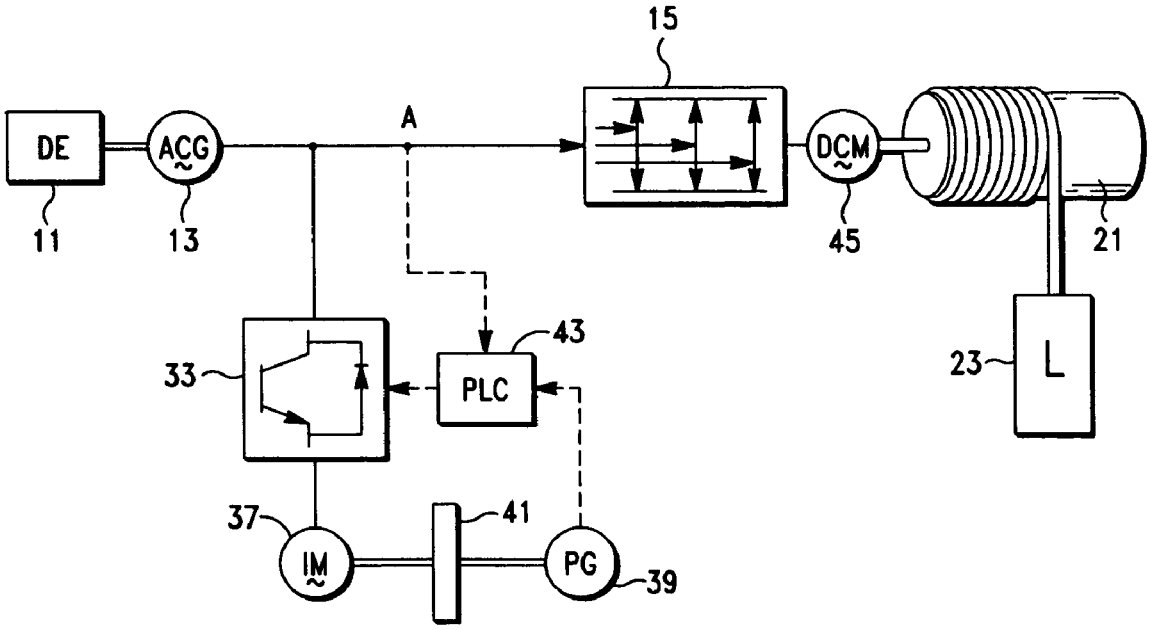
FIG. 4 is a modification of the prior art of FIG. 3 showing the reduction in the number of inverters required by the present invention by utilizing a DC motor for the load hoisting machinery.

Reference is made to FIG. 4 which shows the additional and alternative apparatus of the present invention inserted into the apparatus of the prior art and present practice as shown in FIGS. 1–3. The patented prior art apparatus of FIG. 3 is shown as modified by the technology of the FIG. 4 invention. The induction motor 19 and inverter 17 of FIG. 3 is replaced by a direct current (DC) motor 45 of FIG. 4, and the inverter 35 has been renumbered as 33 to avoid confusion.

Reference is made to FIGS. 5-7, as well as FIGS. 3 & 4, for the relationships of voltage at point A to the AC frequency alpha. The variable graph representations are set forth in the DESCRIPTION OF THE DRAWINGS. The frequency of alpha is determined depending upon the voltage at A. When the load on the hoist drum is small and there is no large power consumption, or reverse power results by the load being lowered, the voltage at A becomes higher than the set value $V_O$ in the controller which is close to the average voltage. In that event, the frequency alpha becomes a plus and energy is stored in the flywheel rotation. When the load is large and power is consumed, the voltage at A becomes lower than the set value $V_O$, and the frequency alpha becomes minus and energy is retrieved from the flywheel rotation.

When the voltage at A is the set value $V_O$, neither storage nor retrieval of energy is effected by the energy storage system. The set value $V_O$ is determined by the average load and mechanical and electrical efficiency. The reduced capacity requirements for the diesel engine and the AC generator permitted by the invention for the operation of the load hoisting machinery can be determined from the average load and mechanical and electrical efficiencies of the machinery.

Figure 8:
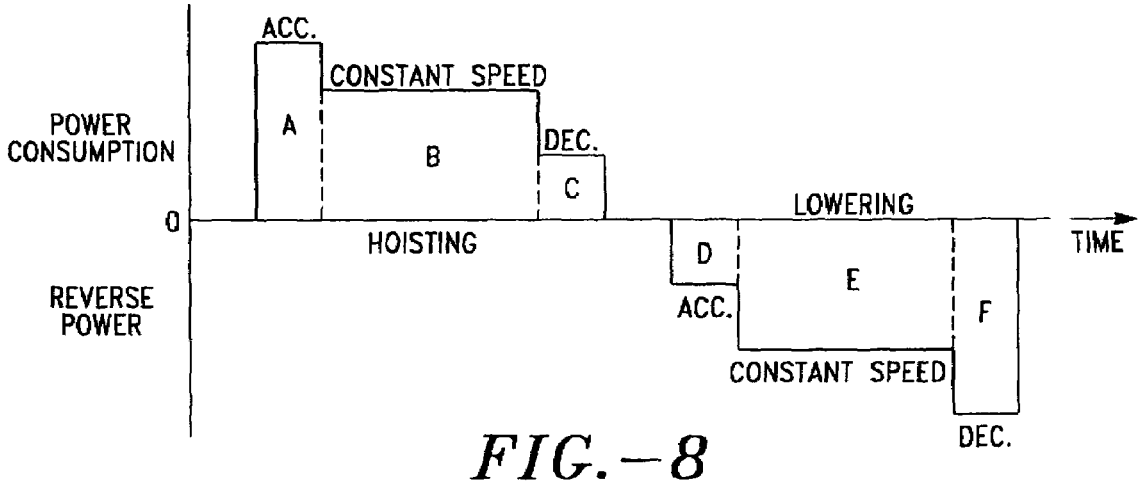
FIG. 8 is a basic power consumption graph for a standard prior art load moving machinery arrangement.

Reference is made to FIG. 8 which shows a graphical power consumption profile especially adaptable for the present invention. It can be utilized for load moving machinery where the loads being moved vary in large amounts or where large inertia changes occur due to acceleration and deceleration of the load, such as in hoisting machines, cranes, tractors, trains, etc. In case of a hoisting machine or a crane, a variable weight load is raised and lowered, and in doing so, the load is accelerated and decelerated. The power consumption of the induction motor for such operation with a specific load is shown graphically illustrated in FIG. 8 where: block A represents the power consumption required to accelerate the load to lift speed; block B represents the power consumption to move and lift the load at constant speed; block C represents the power consumption to stop the movement of the load; block D represents the reverse power or braking effect to permit the load to accelerate to lowering speed; block E represents the reverse power/braking effect to permit the load to lower at constant speed; and block F represents the reverse power/braking effect to stop the lowering of the load. When the load is hoisted, the system consumes power. When the load is lowered, the motor operates to generate power and act as a brake.

Figure 9:
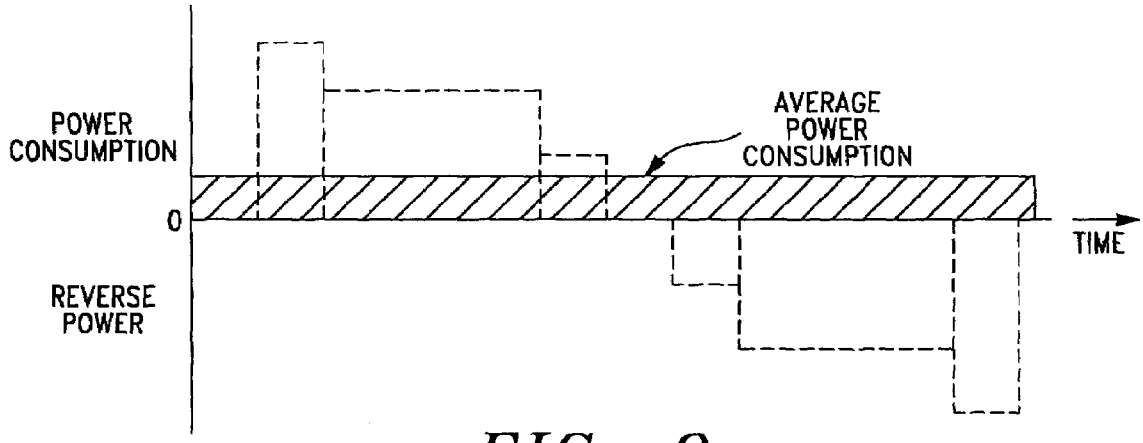
FIG. 9 is an idealistic power consumption graph representation for a drive machinery arrangement utilizing the method of the present invention.

Reference is made to FIG. 9 which shows the graphical power consumption profile which can be achieved with the use of the present invention. Power input is constant and there is unused power when the machinery is not lifting a load, such as when it is idling or at rest but not shut down. The average power consumption is represented by the cross-hatched area of FIG. 9 superimposed on the power consumption graph of FIG. 8.

Figure 10:
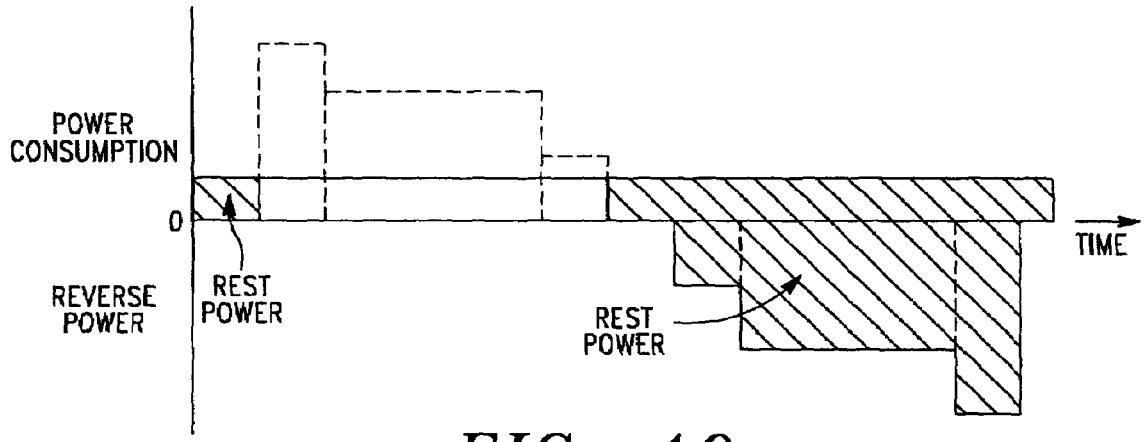
FIG. 10 is a power consumption graph of FIG. 10 defining rest power and showing the power to be stored.

FIG. 10 shows a graphical profile of rest power which is stored in the system of the present invention. When the energy storage system of the present invention is utilized, the rest power, including reverse power and unused power at small load or idle, is stored as flywheel rotation energy and the stored energy is retrieved as power in the peak load or large load situations. The rest power is represented by the reverse cross-hatched area in FIG. 10. The capacity of the main power source is sufficient to supply the average consuming power as shown in FIG. 9. If the load is lowered the same height as hoisted, the average power consumption is just mechanical and electrical efficiency losses.

The present invention comprises a method for energy storage and recovery for load moving machinery powered by a DC motor 45 which is controlled by an AC generator 13 delivering power through a diode converter 15. The steps comprise driving the DC motor to act as a generator and create reverse power when lowering or braking a load. The reverse power combined with unused power, when the load hoisting machinery is at small load or idle, is defined as rest power. The rest power is utilized for driving a second induction motor 37 through an inverter 33, and the rest power is controlled by the inverter. A flywheel 41 is rotated by the second induction motor to store the rest power. When the DC motor is consuming power in excess of its average power consumption, the induction motor is rotated by the flywheel to supply power to the DC motor.

The method of the present invention also includes generating a rotational speed signal proportional to the rotational speed of the flywheel 41 and measuring the voltage at the power input side of the DC motor. The rotational speed signal and the measured voltage are transmitted to a programmable logic controller 43. The measured voltage is compared in the controller with a preset value for determining whether the induction motor 37 should drive or be driven by the flywheel 41. The method further includes that if the controller determines that the measured voltage is higher than the set value, the inverter 33 converts DC to AC with the frequency corresponding to the flywheel rotational speed plus alpha whereby the flywheel is accelerated by the induction motor, and energy is stored in the flywheel rotation. Accordingly, if the voltage is lower than the set value, the inverter controls the AC with the frequency corresponding to the flywheel rotational speed minus alpha whereby the flywheel is decelerated by the induction motor thereby generating reverse power which is supplied to the DC motor through the inverter whereby power is recovered from the flywheel rotation.

The method of the present invention also includes utilizing a DC motor instead of an induction motor for driving the load hoist thereby eliminating an inverter. Larger inverters, such as those used in crane hoist drive systems, are very expensive. Therefore, the new DC drive and power storage system will be cheaper to utilize than an AC drive and system.

The apparatus of the present invention is a load moving machinery energy storage system which includes a direct current (DC) motor 45 interconnected to a wire rope drum 21 for raising and lowering a load 23. The DC motor is controlled by a diode which receives power from a power grid or an engine driven (11) AC generator (ACG) 13. The energy storage system includes a flywheel 41 for storing and discharging energy. The flywheel is driven by an induction motor 37 which is controlled by an inverter 33 and drives a pulse generator 39. A programmable logic controller (PLC) controls the inverter. A means is provided for sensing voltage at the power input side of the DC motor. Programmed logic is provided for said PLC for comparing the sensed voltage and the output of the pulse generator with a set voltage value to determine whether energy should be extracted from or added to the flywheel by decreasing or increasing its rotational speed.

Therefore, in addition to providing a less expensive load hoist apparatus by the present invention, the energy storage system of the present invention is very effective so as to permit the reduction of the capacity of the diesel engine and the AC generator, or the amount of the draw from the power source, and which thereby contributes to an effective energy utilization and savings. Also, in the case that the power source is not stable and fluctuates, the energy storage system of the invention can be used as a power stabilizer.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. A method for energy storage and recovery for load moving machinery, the steps comprising powering said machinery by a DC motor which is controlled by a diode converter, driving said DC motor to act as a generator and create reverse power when lowering or braking a load, said reverse power combined with unused power when said load hoisting machinery is at small load or idle, said combined powers being defined as rest power, utilizing said rest power for driving an induction motor through an inverter, controlling said rest power by said inverter, rotating a flywheel by said induction motor to store said rest power, and rotating said induction motor by said flywheel to supply power through said inverter to said DC motor when said motor is consuming power in excess of its average power consumption.

2. The method of claim 1 including generating a rotational speed signal proportional to the rotational speed of said flywheel, measuring the voltage at the power input side of said DC motor, transmitting said rotational speed signal and said measured voltage to a programmable logic controller, and comparing said measured voltage in said controller with a preset value for determining whether said induction motor should be drive or be driven by said flywheel.

3. The method of claim 2 wherein said controller determines that if said measured voltage is higher than said set value, said inverter converts DC to AC with the frequency corresponding to said rotational speed plus alpha whereby said flywheel is accelerated by said induction motor and energy is stored in said flywheel rotation, and if said voltage is lower than said set value, said inverter controls the AC with the frequency corresponding to said rotational speed minus alpha whereby said flywheel is decelerated by said induction motor thereby generating reverse power which is supplied through said inverter to said DC motor whereby power is recovered from said flywheel rotation.

4. A load moving machinery energy storage system comprising a direct current (DC) motor interconnected to a wire rope drum for raising and lowering a load, said motor being controlled by a diode, an energy storage system including a flywheel for storing and discharging energy, said flywheel being driven by an induction motor controlled by an inverter and driving a pulse generator;

a programmable logic controller (PLC) controlling said inverter, means for sensing voltage at the power input side of said DC motor, programmed logic for said programmable logic controller for comparing said sensed voltage and the output of said pulse generator with a set voltage value, and an engine driven AC generator (ACG) producing power for said load moving machinery and delivering power to said DC motor through a diode.

* * * * *